US006802674B2

(12) United States Patent
Peltonen et al.

(10) Patent No.: US 6,802,674 B2
(45) Date of Patent: Oct. 12, 2004

(54) ARRANGEMENT FOR FEEDING SOLDERING MATERIAL

(75) Inventors: Vesa Peltonen, Tampere (FI); Aulis Kataja, Tampere (FI); Kimmo Ulvelin, Tampere (FI)

(73) Assignee: Sandvik Tamrock Oy, Tampere (FI)

( * ) Notice: Subject to any disclaimer, the term of this patent is extended or adjusted under 35 U.S.C. 154(b) by 86 days.

(21) Appl. No.: 10/159,105

(22) Filed: Jun. 3, 2002

(65) Prior Publication Data

US 2003/0052153 A1 Mar. 20, 2003

Related U.S. Application Data

(63) Continuation of application No. PCT/FI00/01063, filed on Dec. 1, 2000.

(30) Foreign Application Priority Data

Dec. 2, 1999 (FI) ..... 19992597

(51) Int. Cl.[7] ..... B21D 20/02

(52) U.S. Cl. ..... 405/259.5; 405/259.1; 405/269; 411/82; 411/258

(58) Field of Search ..... 405/259.1, 259.4, 405/259.5, 269; 411/82, 82.1, 258, 930

(56) References Cited

U.S. PATENT DOCUMENTS

| | | | | | |
|---|---|---|---|---|---|
| 4,461,600 A | | 7/1984 | Norkus et al. | | |
| 4,655,643 A | * | 4/1987 | Lane et al. | ..... | 405/259.5 |
| 4,765,778 A | * | 8/1988 | Valentine | ..... | 405/259.5 |
| 4,992,004 A | * | 2/1991 | Haug | ..... | 405/269 |
| 5,033,952 A | | 7/1991 | Haug | | |
| 5,112,160 A | * | 5/1992 | Jensen et al. | ..... | 405/259.5 |
| 5,375,947 A | * | 12/1994 | Gouws et al. | ..... | 405/259.5 |
| 5,586,839 A | * | 12/1996 | Gillespie | ..... | 405/259.1 |
| 5,636,945 A | * | 6/1997 | Nes | ..... | 405/259.1 |
| 6,428,243 B1 | * | 8/2002 | Hutchins | ..... | 405/259.1 |
| 6,474,910 B2 | * | 11/2002 | Lay | ..... | 405/259.4 |

FOREIGN PATENT DOCUMENTS

| | | | | |
|---|---|---|---|---|
| DE | 2 222 646 | | 11/1972 | |
| EP | 0 044 272 A2 | | 1/1982 | |
| GB | 2 011 567 A | | 7/1979 | |
| GB | 2 169 050 A | | 7/1986 | |
| JP | 02204524 | * | 8/1990 | ..... 405/259.1 |
| JP | 2002038865 | * | 2/2002 | |
| SE | 510 418 C2 | | 5/1999 | |
| WO | WO 95/33916 | | 12/1995 | |

* cited by examiner

*Primary Examiner*—Jong-Suk (James) Lee
(74) *Attorney, Agent, or Firm*—Burns, Doane, Swecker & Mathis, L.L.P.

(57) ABSTRACT

An arrangement for feeding soldering material into a space between a bolt and rock includes a sleeve-like nozzle which can be pushed tightly against a feed chamber on the rock bolt so that a feed hole in the feed chamber is connected to the inner space of the nozzle. The arrangement further includes a device for placing the nozzle around the feed chamber so that soldering material can be fed from the inner space of the nozzle into the drill hole.

16 Claims, 3 Drawing Sheets

ARRANGEMENT FOR FEEDING SOLDERING MATERIAL

The present application is a continuation of International Application No. PCT/FI00/01063, filed on Dec. 1, 2000. The invention relates to an arrangement for feeding soldering material into a space between a bolt and rock using a rockbolt for bolting, which comprises a separate guide tube around the actual bolt, the guide tube being connected to a feed chamber, which is provided with a feed hole for feeding soldering material into the feed chamber and further into a drill hole through the guide tube, the bolt being arranged to travel through the feed chamber so that it can be fixed in the hole before feeding the soldering material.

BACKGROUND AND SUMMARY

To support rock in tunnel construction and mining, it is nowadays rather common to use a rockbolt in which the end to be pushed into the hole is provided with locking members, such as a wedge anchor, which is then tightened with a support flange and a nut included in the bolt. To fix the bolt firmly to the rock and to protect it from corrosion, the space between the bolt and the hole wall has to be filled with soldering material, such as concrete. In practice, it has been difficult to implement soldering, which has led to development of a new bolt structure, which is described in U.S. Pat. No. 5,636,945. In this solution, a tube to be arranged around the bolt is fastened to a support flange, which will rest against the rock surface, and connected to the feed chamber attached to the flange. There is a hole on the side of the feed chamber, and soldering material can be fed into the feed chamber through this hole and a nozzle for soldering material pushed into the hole and further inside the above-mentioned tube through the feed chamber. From the tube, the soldering material flows along an annular channel between the tube and the bolt to the end of the bolt and back to the beginning of the tube along an annular channel between the tube and the hole walls. Thus the free space can be filled with soldering material reliably and efficiently, and it can be noted that the space is filled up as concrete starts to penetrate out of the hole. According to the above-mentioned patent, the flange is provided with a hole through which the soldering material that has got between the flange and the rock can penetrate, and thus it can be noted that the hole is filled up.

In this bolt structure it is, however, difficult to fill the space with soldering material. To feed soldering material into the feed chamber reliably, the nozzle for soldering material has to be pushed manually into a hole on the side of the feed chamber. This is laborious, difficult and slows down the bolting considerably. Furthermore, in most cases the worker has to be in a cage or the like to reach to the bolt, even though the bolt could be fed and the nut tightened mechanically with a bolting device. The above-mentioned manual stages also pose a considerable safety risk because the worker has to work under a rock that has not been reinforced.

An object of the present invention is to provide an arrangement which enables filling of a drill hole with soldering material safely, easily and, thanks to mechanization, economically using a rockbolt provided with a guide tube and a feed chamber. The arrangement according to the invention comprises a sleeve-like nozzle which can be placed tightly around the feed chamber so that the feed hole of the feed chamber is connected to the inner space of the nozzle, and the arrangement comprises means for feeding soldering material inside the nozzle and therethrough into the feed chamber, and means for placing the nozzle around the feed chamber.

The invention is based on the idea of using, instead of a nozzle for soldering material which is difficult to push tightly into a hole provided on the side of the feed chamber, a sleeve-like nozzle which in the operating position surrounds the feed chamber and in which the inner circumference of the sleeve tightens against the outer surface of the feed chamber and/or the front edge of the sleeve tightens against the flange so that soldering material, when fed into the sleeve, cannot penetrate from between the sleeve and the flange or from between the sleeve and the outer surface of the feed chamber. Instead, the material penetrates into the guide tube through the hole on the side of the feed chamber and further inside the upper part of the bolt, and back down from between the guide tube and the drill hole, which was the intention in the design of the bolt. Another basic idea is that the sleeve-like nozzle is connected to mechanical means which can place it on top of the feed chamber so that soldering material can be fed safely by feeding means of soldering material attached to the nozzle, the feeding means being guided by actuators provided in the usual place on the base of the drilling device. Thus the user does not need to move from his position to feed soldering material.

BRIEF DESCRIPTION OF THE DRAWINGS

The invention will be described in greater detail in the accompanying drawings, in which FIG. 1 schematically illustrates a bolt provided in a drill hole and feeding of soldering material with a nozzle member belonging to the arrangement according to the invention.

DETAILED DESCRIPTION

Figure 1:
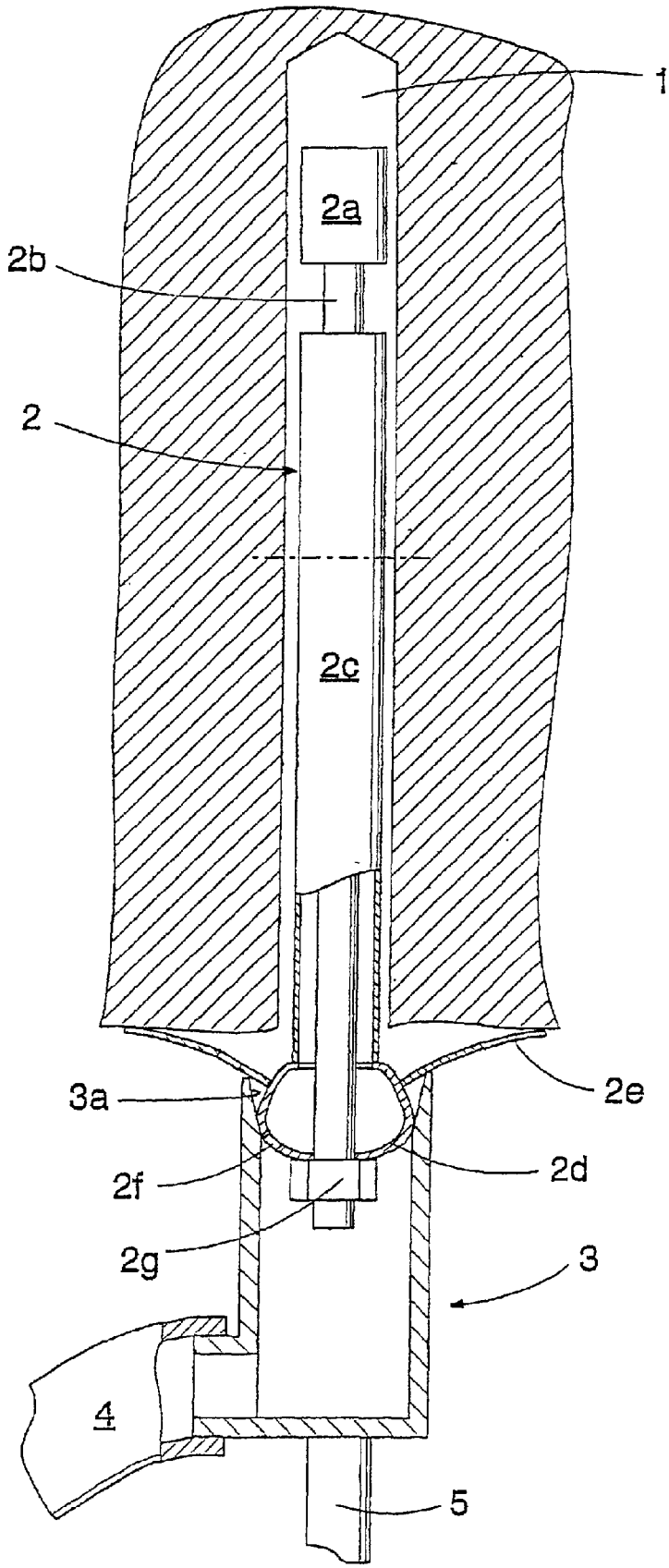

FIG. 1 schematically illustrates a bolt 2 pushed into a drill hole 1, the upper end of the bolt being provided with locking members 2*a*. The locking members 2*a* may be implemented using any suitable means of locking, such as wedge locking. There is a guide tube 2*c* around the part 2*b* of the bolt that actually carries the load. The lower end of the tube is connected to a feed chamber 2*d*. There is also a flange 2*e* attached to the feed chamber so that the guide tube 2*c*, feed chamber 2*d* and flange 2*e* form an entity. The feed chamber 2*d* is round in cross-section and comprises a feed hole 2*f* through which soldering material can be fed into the feed chamber 2*d* and further inside the guide tube 2*c*. The actual bolt part 2*b* travels through the feed chamber 2*d* and a nut 2*g* or another clamping member for tightening the bolt using wedge locking to provide adequate tightness before feeding soldering material.

FIG. 1 also shows a sleeve-like nozzle 3 for soldering material which is placed around the feed chamber 2*d* after the bolt 2 has been tightened. The nozzle 3 comprises a sealing surface 3*a* which settles tightly along the outer surface of the feed chamber 2*d*, thus forming a tight joint with the feed chamber 2*d*. The sealing surface may be formed on the sleeve-like inner surface of the nozzle to provide a slightly conical sleeve-like inner surface as shown in the figure. In that case, as the nozzle is pushed, the conical sealing surface 3*a* is pressed against the outer surface of the feed chamber 2*d*, which is round in cross-section, thus forming a line-like contacting surface which functions as a seal. There is also a delivery hose 4 connected to the nozzle 3. Soldering material can be fed into the nozzle through the hose and from the nozzle into the feed chamber and further. The nozzle 3 is connected to a supporting arm 5 shown in the figure or to another supporting member by means of which it can be pushed into its place for feeding of the soldering material. A device suitable for this purpose is shown in greater detail in FIGS. 4*a* and 4*b*.

Figure 2A:
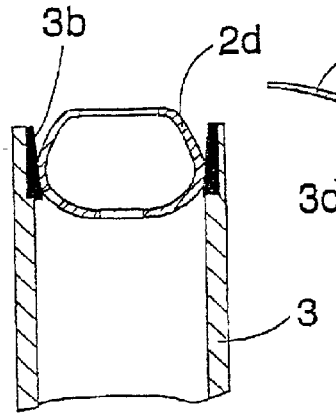
FIGS. 2*a* to 2*c* illustrate tightening of the nozzle member to the feed chamber of the bolt and to the flange in greater detail, FIGS. 3*a* and 3*b* schematically illustrate a bolting device by means of which soldering material can be fed using the arrangement of the invention, and FIGS. 4*a* and 4*b* schematically illustrate another embodiment of the arrangement according to the invention.
Figure 2B:
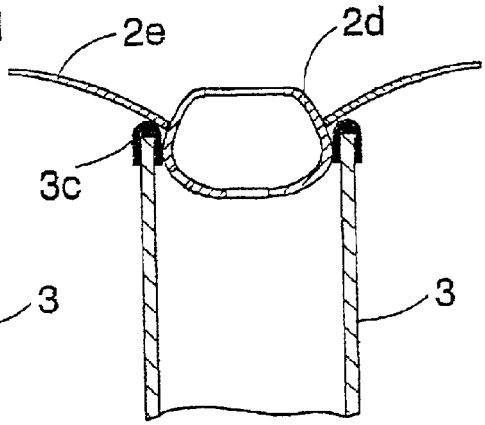
Figure 2C:
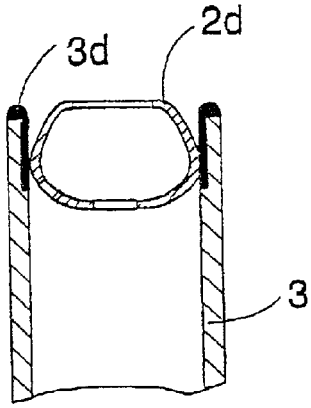

FIGS. 2*a* to 2*c* illustrate embodiments for tightening the nozzle 3 against the feed chamber 2*d* or the flange 2*e*, which differ from those shown in FIG. 1. FIG. 2*a* illustrates an embodiment where a seal 3*b* for sealing the nozzle 3 against the feed chamber 2*d* is provided on the inner surface of the nozzle 3. The inner surface of the seal 3*b* is preferably slightly conical, in which case it will seal easily against the feed chamber 2*d*. The inner surface of the seal may also have a different shape, i.e. the inner surface can be completely cylindrical or partly cylindrical with a conical front edge. Seals of other kind can also be used. FIG. 2*b* illustrates a solution in which a seal 3*c* is provided at the front edge of the nozzle 3, the seal being pressed against the flange 2*e* as the nozzle 3 is placed in its operating position around the feed chamber 2*d*. FIG. 2*c* shows a solution in which the nozzle 3 is provided with a sleeve-like seal 3*d*, which forms a uniform seal from inside the nozzle 3 to its front edge, preferably beyond the front surface as shown in the figure. Such a sleeve-like seal is easy to produce and install, and it can be changed quickly when it is worn out.

Figure 3A:
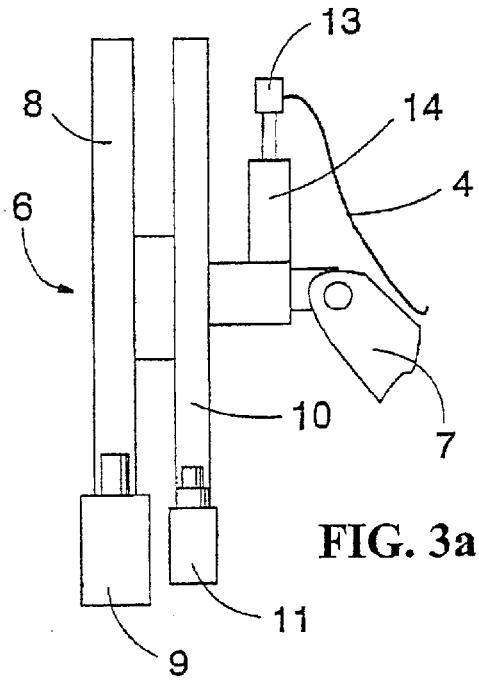
Figure 3B:
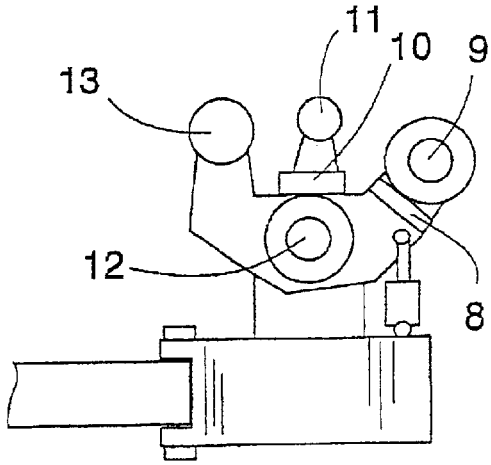

FIGS. 3*a* and 3*b* are schematic side and top views of a rock bolting apparatus in which the arrangement can be applied. A rock bolting device 6, which is fully known per se and described e.g. in German patent no. 2222646, is attached to a boom 7 whose one end is attached to a base (not shown), which is fully known per se. The rock bolting device 6 is pivoted to the boom 7 in a manner known per se, for which reason this is not described in greater detail. The rock bolting device 6 comprises e.g. a drilling machine 9 for drilling a hole in the rock first. The drilling machine 9 moves along a feed beam 8 as shown in the figure. It further comprises a bolt feeding device 11, which moves along another feed beam 10. The apparatus may also include a bolt cartridge and transfer members known per se (not shown) for transferring bolts to the feeding device 11. Such bolt cartridges and transfer members are fully known per se, and since they are not relevant to the present invention, they will not be described in greater detail. The rock bolting device further comprises a vertical joint 12, which is parallel with the axis of the feed beams 8 and 10 and around which the rock bolting device can be turned so that the rock drilling machine 9 and the bolt feeding device 11 will be in the same place to allow remote-controlled, or if desired, totally automatic feeding of a bolt into a drilled hole. This is called indexing, which is fully known per se e.g. from German patent no. 2222646, and thus its function and actuators need not be described in greater detail.

In addition, FIGS. 3*a* and 3*b* show a feeding unit 13 for soldering material, which is provided with a sleeve-like nozzle of FIG. 1 or 2*a* to 2*c* included in the arrangement according to the invention. This sleeve-like nozzle is arranged with respect to the axis 12 so that it can be turned coaxially with the drilled hole. The nozzle 3 (seen in, e.g., FIGS. 1–2*c*) can preferably be moved with respect to the bolting device 6 parallel with the axis 12, and it comprises an actuator 14, preferably a pressure-fluid operated cylinder, by means of which the nozzle 3 can be firmly placed around the feed chamber of the bolt and held there to feed preferably concrete into the drill hole around the bolt through the feed chamber.

Figure 4A:
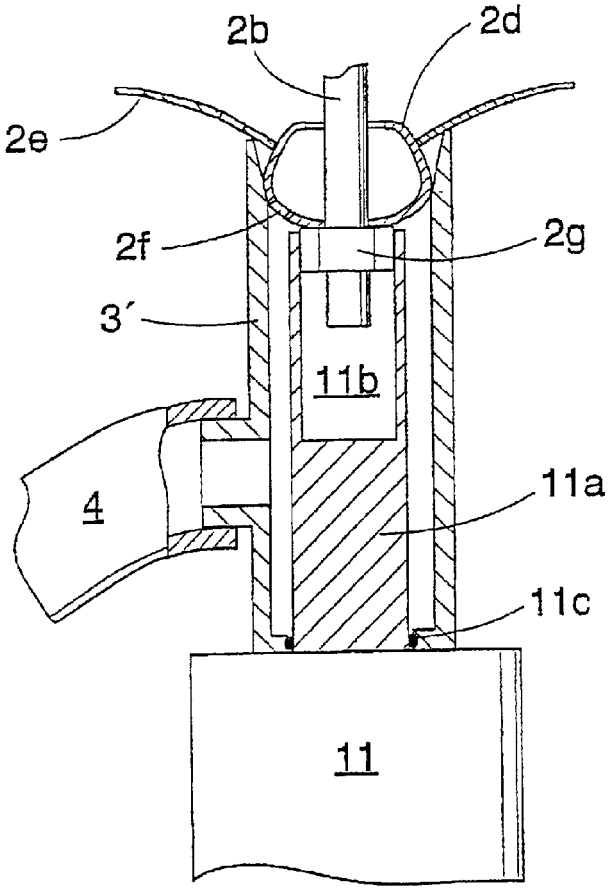
Figure 4B:
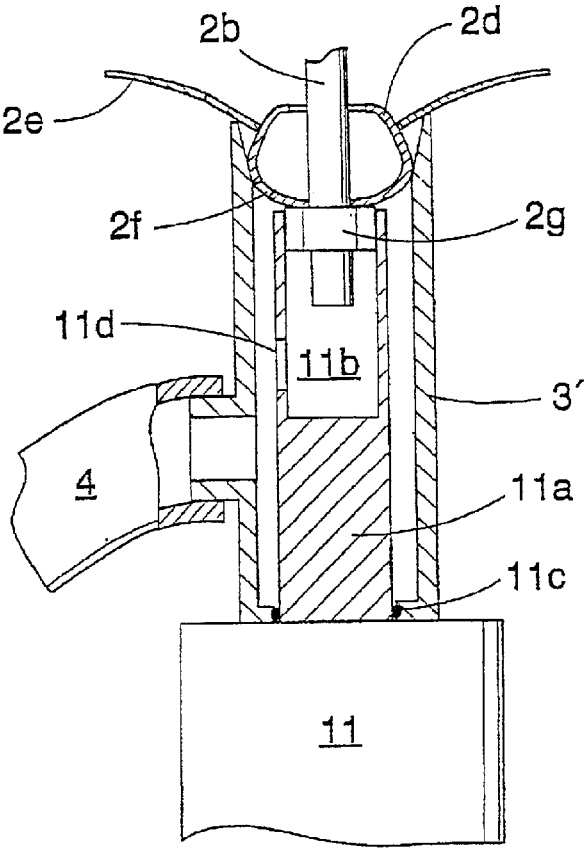

FIGS. 4*a* and 4*b* schematically illustrate other embodiments of the nozzles included in the arrangement according to the invention. In these embodiments the nozzle 3' is also sleeve-like and is arranged in the bolt feeding device 11. The bolt feeding device 11, which moves along the feed beam 10 shown in FIGS. 3*a* and 3*b* when a bolt is being fed, comprises a rotating tool 11*a*, which contains a clamping space 11*b* for a clamping member, such as the nut 2*g* of the bolt or the like, which rotates the nut 2*g* of the bolt shown in the figure during pre-fastening of the bolt. In this embodiment the tool 11*a* is arranged to pass through the bottom of the nozzle 3' and is sealed against the nozzle with a seal 11*c* so that soldering material cannot penetrate out from between the nozzle 3' and the tool 11*a*. In this embodiment the bolt can be pushed into its place when the nozzle 3' is around the feed chamber 2*d* of the bolt. After the bolt has been pushed into the hole, it can be pre-tightened to its place by the tool 11*a*, after which soldering material can be immediately fed into the drill hole through the feed chamber 2*d*. It is also possible to start feeding of soldering material already during tightening of the nut. FIG. 4*b* illustrates another embodiment of the arrangement of the invention where the tool 11*a* of the bolt feeding device 11 is provided with one or more openings 11*d*, such as holes, which extend from the clamping space 11*b* of the tool 11*a* to the outer surface of the tool 11*a*. In that case any soldering material that has penetrated into the clamping space 11*b* can exit it when the next bolt is introduced, and thus the clamping space 11*b* cannot fill with soldering material, which might interrupt the bolting. Naturally, the tool 11*a* can be implemented in several ways, provided that it can rotate the nut of the bolt and any other component of any shape used for tightening. It is essential that the tool and the component used for tightening are compatible so that the bolt can be pre-tightened to its place. A bolt the upper end of which is provided with threads or a similar component which is rotated to provide pre-tightening can also be applied in the arrangement of the invention.

The above description and drawings only exemplify the invention and do not limit the invention in any way. It is essential that the arrangement comprise a sleeve-like nozzle which can be arranged around the feed chamber of the bolt so that it seals against the feed chamber and/or the flange, which enables feeding of soldering material into the drill hole through the feed chamber in the intended manner. Thus soldering can be performed even though the bolt were not provided with a tube around it in accordance with U.S. Pat. No. 5,636,945, but with a feed chamber in connection with the flange.

What is claimed is:

1. An arrangement for feeding soldering material into a space between a bolt and a surface of a drill hole, comprising:

a guide tube adapted to be disposed around a bolt in a drill hole;

a feed chamber connected to the guide tube, the feed chamber having a feed hole providing flow communication for soldering material into the feed chamber and into the drill hole through the guide tube, the feed chamber including an opening permitting the bolt to extend through the feed chamber so that the bolt can be fixed in the drill hole;

a sleeve-shaped nozzle having a sealing surface; and means for moving the nozzle so that the sealing surface seals an outer surface of the feed chamber and so that the feed hole communicates with an inner space of the nozzle and so that soldering material can be fed from the inner space of the nozzle into the drill hole.

2. An arrangement according to claim 1, wherein the sealing surface is disposed inside the nozzle.

3. An arrangement according to claim 2, wherein the sealing surface is formed by a separate seal attached to a nozzle body.

4. An arrangement according to claim 1, wherein the sealing surface is disposed at a front edge of the nozzle.

5. An arrangement according to claim 4, wherein the sealing surface is formed by a separate seal attached to a nozzle body.

6. An arrangement according to claim 4, wherein the sealing surface is adapted to seal the outer surface of the feed chamber at least by a seal at the front edge of the nozzle.

7. An arrangement according to claim 4, wherein the sealing surface is disposed inside the nozzle.

8. An arrangement according to claim 7, wherein the sealing surface is formed by a separate seal attached to a nozzle body.

9. An arrangement according to claim 7, wherein the sealing surface is adapted to seal the outer surface of the feed chamber at least by seals at the inside of the nozzle and at the front edge of the nozzle.

10. An arrangement according to claim 1, further comprising means for feeding soldering material to the inner space of the nozzle and therethrough into the feed chamber.

11. An arrangement according to claim 10, wherein the feeding means includes a hose.

12. A rock bolting device, comprising:

a bolt feeding device, the bolt feeding device comprising a clamping tool for securing a clamping member to a bolt, an arrangement for feeding soldering material into a space between the bolt and a surface of a drill hole, the arrangement including a guide tube adapted to be disposed around the bolt in a drill hole, a feed chamber connected to the guide tube, the feed chamber having a feed hole providing flow communication for soldering material into the feed chamber and into the drill hole through the guide tube, the feed chamber including an opening permitting the bolt to extend through the feed chamber so that the bolt can be fixed in the drill hole, a sleeve-shaped nozzle having a sealing surface, and means for moving the nozzle so that the sealing surface seals an outer surface of the feed chamber and so that the feed hole communicates with an inner space of the nozzle and so that soldering material can be fed from the inner space of the nozzle into the drill hole, wherein the nozzle includes an opening through which a portion of the clamping tool extends and, when the bolt feeding device feeds a bolt into a drill hole, the clamping device is adapted to secure the clamping member to the bolt at the same time that soldering material is fed into the feed chamber through the nozzle.

13. The rock bolting device of claim 12, wherein the clamping tool includes a clamping space in which the clamping member is adapted to be disposed, the clamping tool including at least one opening from the clamping space to an exterior of the clamping tool of sufficient size to permit soldering material in the clamping space to exit the clamping space when another clamping member for another bolt is introduced into the clamping space.

14. The rock bolting device of claim 12, further comprising at least one actuator for transferring a bolt in a longitudinal direction of the nozzle.

15. A rock bolting device, comprising:

a bolt feeding device for feeding a bolt into a drill hole;

an arrangement for feeding soldering material into a space between the bolt and a surface of the drill hole, the arrangement including a sleeve-shaped nozzle having an inner space and a sealing surface, means for moving the nozzle so that the sealing surface seals around an opening to the drill hole, and so that the drill hole is in flow communication with the inner space of the nozzle and so that soldering material can be fed from the inner space of the nozzle into the drill hole, wherein the bolt feeding device includes a clamping tool for securing a clamping member to a bolt, wherein the nozzle includes an opening through which a portion of the clamping tool extends and, when the bolt feeding device feeds the bolt into the drill hole, the clamping device is adapted to secure the clamping member to the bolt at the same time that soldering material is fed into the drill hole through the nozzle.

16. The rock bolting device of claim 15, wherein the clamping tool includes a clamping space in which the clamping member is adapted to be disposed, the clamping tool including at least one opening from the clamping space to an exterior of the clamping tool of sufficient size to permit soldering material in the clamping space to exit the clamping space when another clamping member for another bolt is introduced into the clamping space.

* * * * *